US008491096B2

(12) United States Patent
Kobayashi et al.

(10) Patent No.: US 8,491,096 B2
(45) Date of Patent: Jul. 23, 2013

(54) LIQUID EJECTING HEAD, LIQUID EJECTING HEAD UNIT, LIQUID EJECTING APPARATUS, AND METHOD OF MANUFACTURING LIQUID EJECTING HEAD

(75) Inventors: Hiroyuki Kobayashi, Shiojiri (JP); Shigeki Suzuki, Shiojiri (JP); Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 99 days.

(21) Appl. No.: 13/280,933

(22) Filed: Oct. 25, 2011

(65) Prior Publication Data

US 2012/0113189 A1 May 10, 2012

(30) Foreign Application Priority Data

Nov. 4, 2010 (JP) ..... 2010-247147

(51) Int. Cl.
*B41J 2/16* (2006.01)

(52) U.S. Cl.
USPC ..... 347/47

(58) Field of Classification Search
USPC ..... 347/40, 43, 47; 29/890.1
See application file for complete search history.

(56) References Cited

U.S. PATENT DOCUMENTS 8,235,501 B2 * 8/2012 Oguchi ..... 347/47
8,382,245 B2 * 2/2013 Akahane ..... 347/40
2005/0046668 A1 3/2005 Owaki

FOREIGN PATENT DOCUMENTS

JP 2005-096419 4/2005

* cited by examiner

*Primary Examiner* — Lamson Nguyen
(74) *Attorney, Agent, or Firm* — Workman Nydegger

(57) ABSTRACT

A liquid ejecting head includes: a head main body including a nozzle opening that ejects a liquid; and a fixed plate fixed to a liquid ejecting surface of the head main body, and including an exposure opening, the nozzle opening of the head main body being formed in the liquid ejecting surface of the head main body, the nozzle opening of the liquid ejecting surface being exposed to the exposure opening. A positioning hole open to the liquid ejecting surface and positioned with respect to the nozzle opening is provided in the head main body. The fixed plate is fixed to the liquid ejecting surface so as to close the positioning hole. The fixed plate includes an extension portion protruding from the liquid ejecting surface. At least two head positioning holes are provided in the extension portion.

17 Claims, 14 Drawing Sheets

LIQUID EJECTING HEAD, LIQUID EJECTING HEAD UNIT, LIQUID EJECTING APPARATUS, AND METHOD OF MANUFACTURING LIQUID EJECTING HEAD

The entire disclosure of Japanese Patent Application No: 2010-247147, filed Nov. 4, 2010 is expressly incorporated by reference herein.

BACKGROUND

1. Technical Field

The present invention relates to a liquid ejecting head ejecting a liquid from a nozzle opening, a liquid ejecting head unit, a liquid ejecting apparatus, and a method of manufacturing a liquid ejecting head.

2. Related Art

There is known a liquid ejecting head ejecting liquid droplets from nozzles by applying pressure to a liquid by a piezoelectric actuator such as a piezoelectric element or a pressure generator such as a heat generating element. The liquid ejecting head is typified by an ink jet recording head ejecting ink droplets.

As the ink jet recording head (unit), there is known an ink jet recording head unit configured as disclosed in, for example, JP-A-2005-096419. The ink jet recording head unit disclosed therein includes a plurality of head main bodies each including a nozzle plate in which nozzle openings for ejecting ink droplets are pierced and a channel formation substrate on which a plurality of pressure generation chambers communicating with the nozzle openings and channels for reservoirs (communication units) communicating with the respective pressure generation chambers are formed. The ink jet recording head unit is configured so that the head main bodies are fixedly positioned on a fixing plate.

However, the known ink jet recording head unit has the following problems. If positioning holes penetrating each of the head main bodies in a thickness direction of the head main body at a time of assembling the head main body are exposed to a liquid discharge surface of the head main body, then ink enters the head main body from the positioning holes, and the head main body is highly likely damaged by the ink.

Furthermore, closure of liquid-discharge-surface-side openings of the positioning holes of the head main body with a fixed plate such as a cover head may prevent entry of the ink into the head main body. This configuration, however, requires using an expensive aligner including an imaging unit or the like to position the nozzle openings with respect to the fixing plate, disadvantageously resulting in cost increase.

The above-stated problems occur not only to the ink jet recording heads but also a liquid ejecting apparatus ejecting a liquid other than the ink.

SUMMARY

An advantage of some aspects of the invention is that a liquid ejecting head, a liquid ejecting head unit, a liquid ejecting apparatus, and a method of manufacturing a liquid ejecting head capable of preventing damage to an interior of the liquid ejection head by a liquid and reducing a manufacturing cost of the liquid ejecting head can be provided.

According to an aspect of the invention, a liquid ejecting head includes: a head main body including a nozzle opening that ejects a liquid; and a fixed plate fixed to a liquid ejecting surface of the head main body and including an exposure opening, the nozzle opening of the head main body being formed in the liquid ejecting surface of the head main body, the nozzle opening of the liquid ejecting surface being exposed to the exposure opening. In the liquid ejecting head according to the aspect of the invention, a positioning hole open to the liquid ejecting surface and positioned with respect to the nozzle opening is provided in the head main body, the fixed plate is fixed to the liquid ejecting surface so as to close the positioning hole, the fixed plate includes an extension portion protruding from the liquid ejecting surface and at least two head positioning holes provided in the extension portion.

According to the aspect of the invention, the fixed plate closes the positioning hole open to the liquid ejecting surface. This may prevent the liquid adhering onto the liquid ejecting surface from entering into the head main body via the positioning hole, and prevent damage to the head main body by the liquid. Further, by providing the head positioning holes that do not face the liquid ejecting surface in the fixed plate, the head positioning holes may be used at a time of positioning and fixing the liquid ejecting head.

It is preferable that the extension portion is provided on one side surface of the head main body in a short-side direction of the head main body, and that the head positioning holes are provided in the extension portion in a long-side direction of the head main body. In this case, it is possible to prevent the liquid ejection head from being elongated in a long-side direction, arrange the two head positioning holes to be relatively distant from each other, and highly accurately position the head main body and the fixed plate. It is also possible to highly accurately position the liquid ejecting head using the head positioning hole.

It is preferable that the head main body includes a case member provided on an opposite side to the liquid ejecting surface, and that the case member includes a protrusion facing a region of the extension portion other than the region including the positioning holes. In this case, it is possible to reinforce the extension portion with the protrusion and prevent damage to the extension portion such as a deformation of the extension portion.

It is preferable that the extension portion is provided on each of both ends of the liquid ejecting head in a long-side direction of the liquid ejecting head, and that the head positioning hole is provided in each of the extension portions provided on the both ends of the liquid ejecting head in the long-side direction of the liquid ejecting head. In this case, it is possible to prevent the liquid ejecting head from becoming wide in the short-side direction. Furthermore, it is possible to reduce a distance between the nozzle openings of the adjacent liquid ejecting heads without rotating directions of the liquid ejecting heads when aligning the liquid ejecting head in the short-side direction.

According to another aspect of the invention, a liquid ejecting head unit includes: a plurality of liquid ejecting heads according to the above aspect of the invention; and a holding member collectively holding opposite surfaces of the liquid ejecting heads to liquid ejecting surfaces of the liquid ejecting heads.

According to the other aspect, it is possible to form nozzle rows elongated by a plurality of liquid ejecting heads without elongating each liquid ejecting head.

According to yet another aspect of the invention, a liquid ejecting head unit includes: a plurality of liquid ejecting heads according to the above aspect of the invention; and a holding member collectively holding opposite surfaces of the liquid ejecting heads to liquid ejecting surfaces of the liquid ejecting heads, wherein the liquid ejecting heads are aligned on the holding member in a short-side direction of the holding member, and the liquid ejecting heads adjacent in the short-side direction are arranged so that opposite side surfaces of the liquid ejecting heads to side surfaces on which the head positioning holes are provided face each other. According to the yet other aspect of the invention, it is possible to reduce the distance between the nozzle openings of the two liquid ejecting heads adjacent in the short-side direction.

According to still another aspect of the invention, a liquid ejecting apparatus includes the liquid ejecting head unit according to the other aspect of the invention.

According to the still other aspect of the invention, it is possible to realize the liquid ejecting apparatus capable of preventing damage and having high reliability.

According to a further aspect of the invention, a liquid ejecting apparatus includes a liquid ejecting head unit according to the yet other aspect of the invention.

According to the further aspect of the invention, it is possible to realize the liquid ejecting apparatus capable of preventing damage and having high reliability.

According to a still further aspect of the invention, there is provided a method of manufacturing a liquid ejecting head, the liquid ejecting head including: a head main body including a nozzle opening that ejects a liquid; and a fixed plate fixed to a liquid ejecting surface of the head main body, and including an exposure opening, the nozzle opening of the head main body being formed in the liquid ejecting surface of the head main body, the nozzle opening of the liquid ejecting surface being exposed to the exposure opening. The method includes: positioning the head main body and the fixed plate relatively to each other by inserting positioning pins into a positioning hole formed in the head main body and penetrating the head main body in a thickness direction of the head main body and a head positioning hole provided in an extension portion of the fixed plate protruding from the liquid ejecting surface from an opposite surface of the head main body to the liquid ejecting surface; closing a liquid ejecting surface-side opening of the positioning hole of the head main body by the fixed plate; and fixing the head main body to the fixed plate.

According to the still further aspect of the invention, the fixed plate closes the positioning hole open to the liquid ejecting surface. This may prevent the liquid adhering onto the liquid ejecting surface from entering into the head main body via the positioning hole, and prevent damage to the head main body by the liquid. Further, by providing the head positioning holes that do not face the liquid ejecting surface in the fixed plate, the head positioning holes may be used at a time of positioning and fixing the liquid ejecting head.

BRIEF DESCRIPTION OF THE DRAWINGS

The invention will be described with reference to the accompanying drawings, wherein like reference numbers denote like elements.

DESCRIPTION OF EXEMPLARY EMBODIMENTS

The invention will be described hereinafter based on embodiments.

First Embodiment

Figure 1:
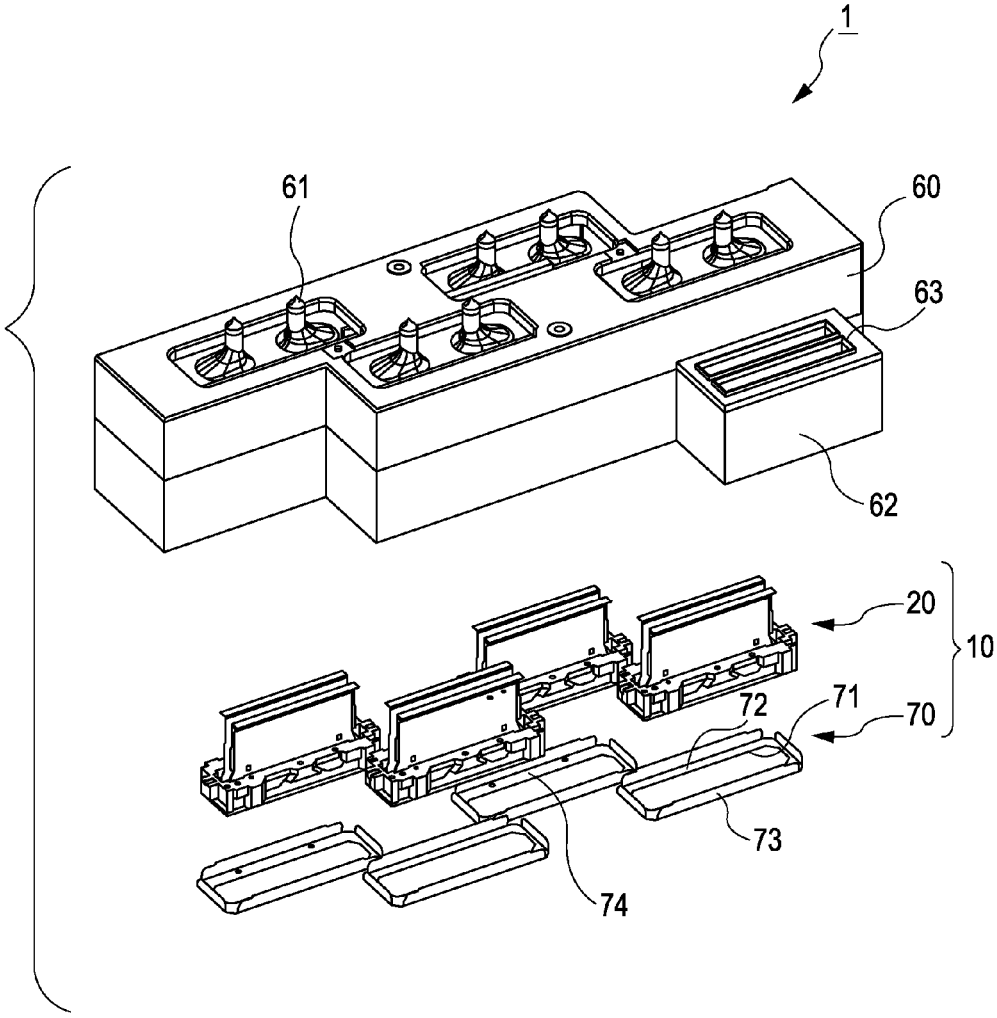
FIG. 1 is an exploded perspective view of a liquid ejecting head unit according to a first embodiment of the invention.
Figure 2:
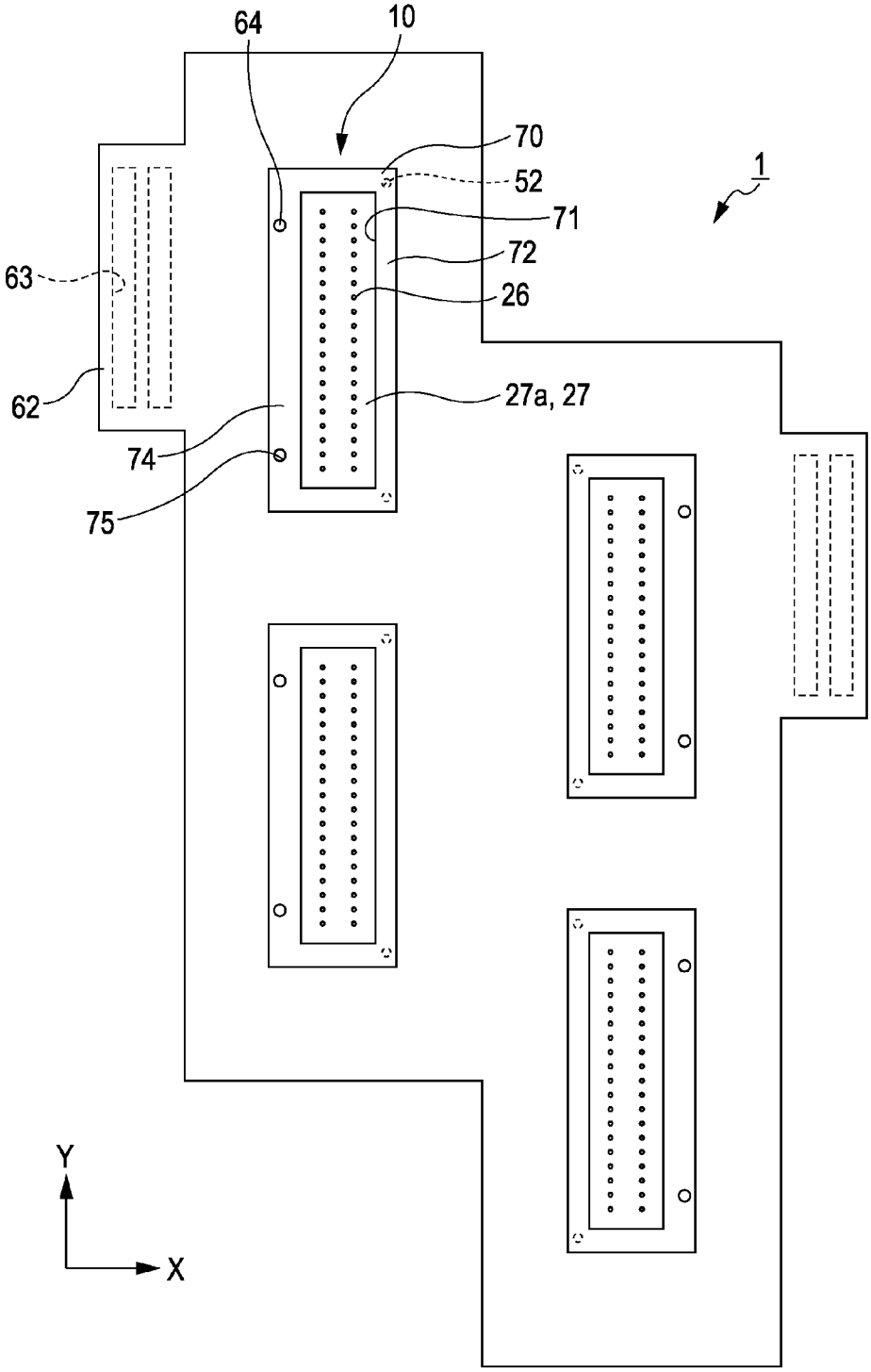
FIG. 2 is a plan view of the liquid ejecting head unit according to the first embodiment.

FIG. 1 is an exploded perspective view of an ink jet recording head unit that is an example of a liquid ejecting head unit according to a first embodiment of the invention. FIG. 2 is a plan view of the ink jet recording unit viewed from a liquid ejecting surface-side.

As shown in FIGS. 1 and 2, an ink jet recording head unit 1 (hereinafter, also simply "head unit 1") includes a plurality of (four in the first embodiment) ink jet recording heads 10 (hereinafter, also simply "head 10") that are exemplary liquid ejecting heads, and a holding member 60.

The holding member 60 is made of, for example, a resin material and includes therein a circuit substrate, a channel member in which ink communication paths are formed, a filter removing dust and/or bubbles, and the like. A plurality of (eight in the first embodiment) ink supply needles 61 is fixed onto an upper surface of the holding member 60 (an opposite surface of the holding member 60 to the head 10). Storage units (not shown) in which inks of respective colors are stored are connected to the ink supply needles 61 either directly or via tubes. One end of each ink communication path (not shown) communicates with each ink supply needle 61. The other end of the ink communication path is open toward a head main body 20 (a bottom of the holding member 60). That is, inks are supplied from ink cartridges (not shown) to the ink communication paths via the corresponding ink supply needles 61 and then supplied to respective head main bodies 20 via ink introduction paths to be described later in detail.

On the bottom of the holding member 60 configured as stated above, the heads 10 are positioned at predetermined intervals. The heads 10 correspond to the inks of the respective colors.

The heads 10 held by the holding member 60 are arranged in a staggered fashion in a first direction Y that is a long-side direction of the heads 10, thereby making it possible to form a row of nozzles ("nozzle row") extending at the same pitch in the first direction Y. "To arrange the heads 10 in a staggered fashion" means as follows. The heads 10 are aligned in the first direction Y that also serves as a direction in which nozzle openings 26 (see FIG. 2), to be described later, are aligned.

Two nozzle rows (hereinafter, simply "rows"), each including a plurality of (two) heads aligned in the first direction Y, are aligned in a second direction X crossing the direction (first direction Y) in which the nozzle openings 26 are aligned. The two rows of heads 10 aligned in the second direction X are arranged at positions slightly shifted from each other in the first direction Y. The two heads 10 adjacent in the two rows of heads 10 are arranged so that the nozzle opening located on an end of one row of heads 10 is at the same position as that of the nozzle opening located on an end of the other row of heads 10 in the first direction Y. It is thereby possible to continuously arrange the nozzle openings at the same pitch in the first direction Y over as much as a plurality of (four in the first embodiment) heads 10 and perform printing over a wide area at a width of the continuous rows.

Note that the holding member 60 has a shape formed by cutting a pair of diagonal corners from a rectangle in a top view. The shape of the holding member 60 obtained by cutting the paired diagonal corners from the rectangle is specifically paraphrased into the following structure. A convex portion and a concave portion in a top view are aligned on each of long-side ends of the holding member 60 in a short-side direction. The convex and concave portions are arranged to be inverted with respect to each other on the long-side ends of the holding member 60. The concave portions on both long-side ends correspond to the paired diagonal corners cut out from the rectangle, respectively.

The two rows of heads 10 aligned in the second direction X are arranged at positions slightly shifted from each other in the first direction Y so as to be located in the convex portions protruding from both long-side ends of the holding member 60, respectively.

Furthermore, the holding member 60 includes extensions 62 that extend from portions of long sides of the holding member 60 in the short-side direction, respectively. That is, the holding member 60 includes the extensions 62 extending in the short-side direction. Although not shown, a connector of a circuit substrate provided in the holding member 60 is arranged on each of the extensions 62 and an external interconnection is connected to a connector of an interconnection substrate through a slit 63 formed on an upper surface of each extension 62. Note that driving interconnections 35 of the heads 10 are connected to the circuit substrate as described later.

Figure 3:
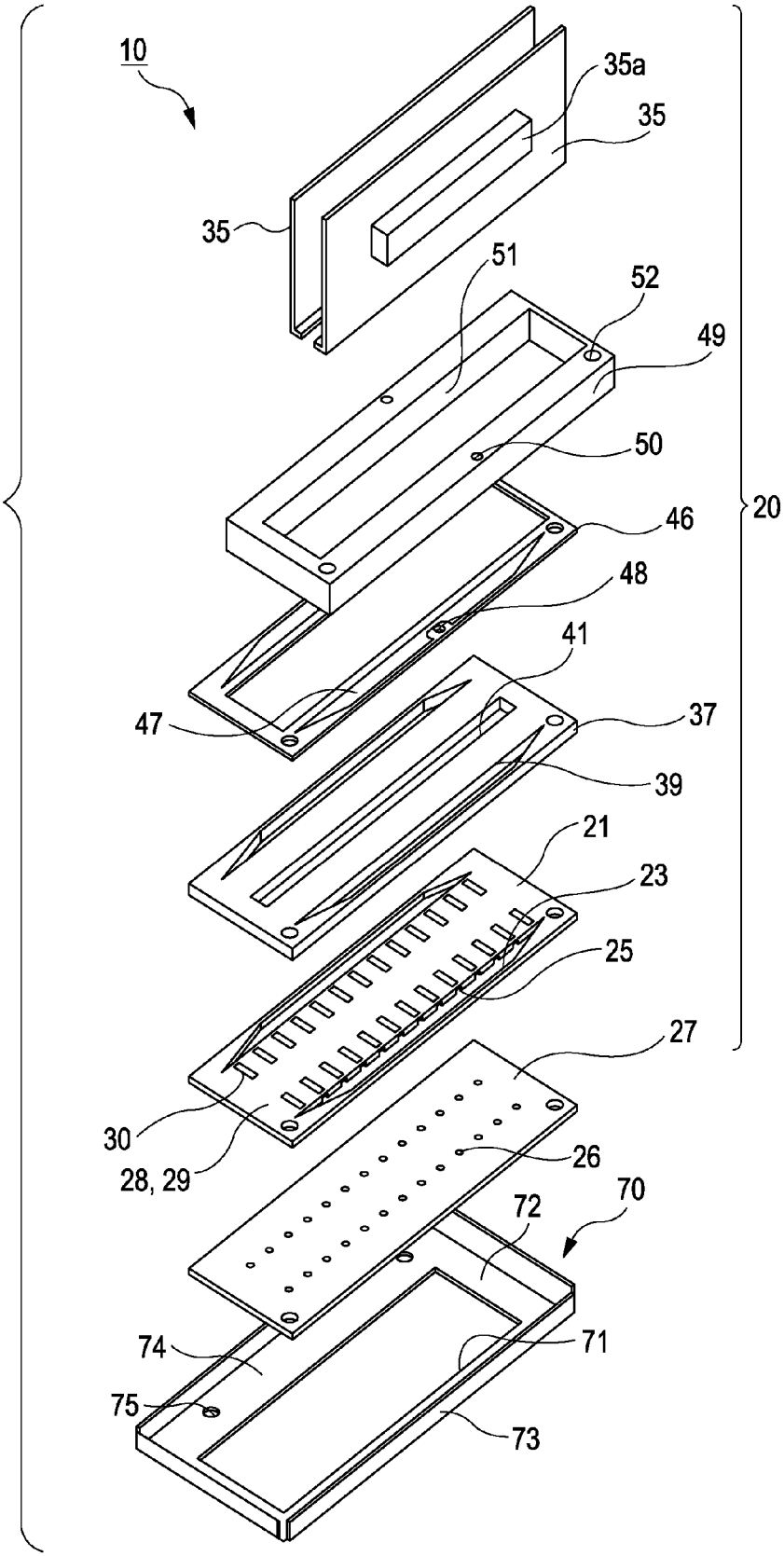
FIG. 3 is an exploded perspective view of a liquid ejecting head according to the first embodiment.
Figure 4:
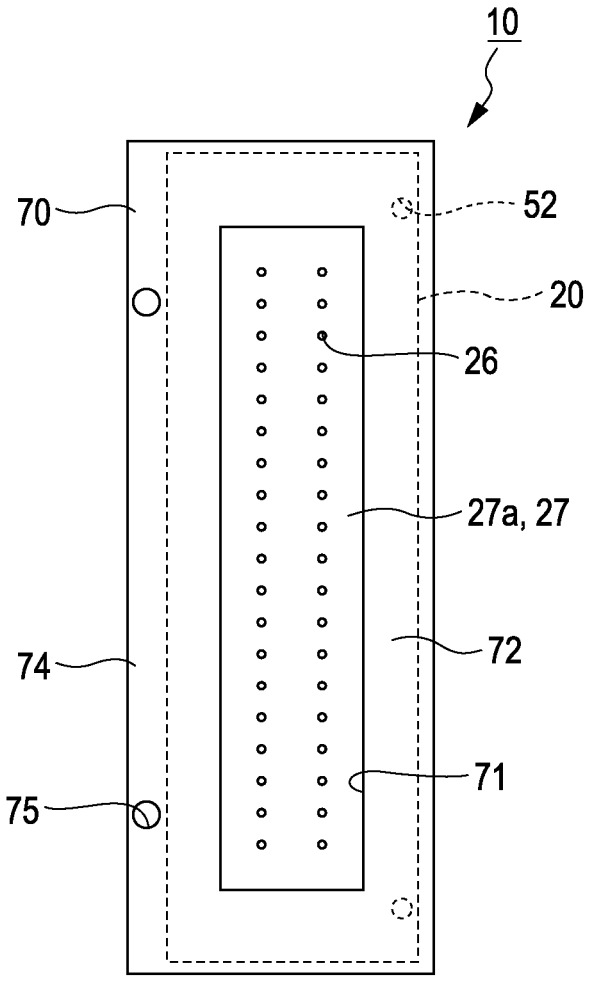
FIG. 4 is a plan view of the liquid ejecting head according to the first embodiment.
Figure 5:
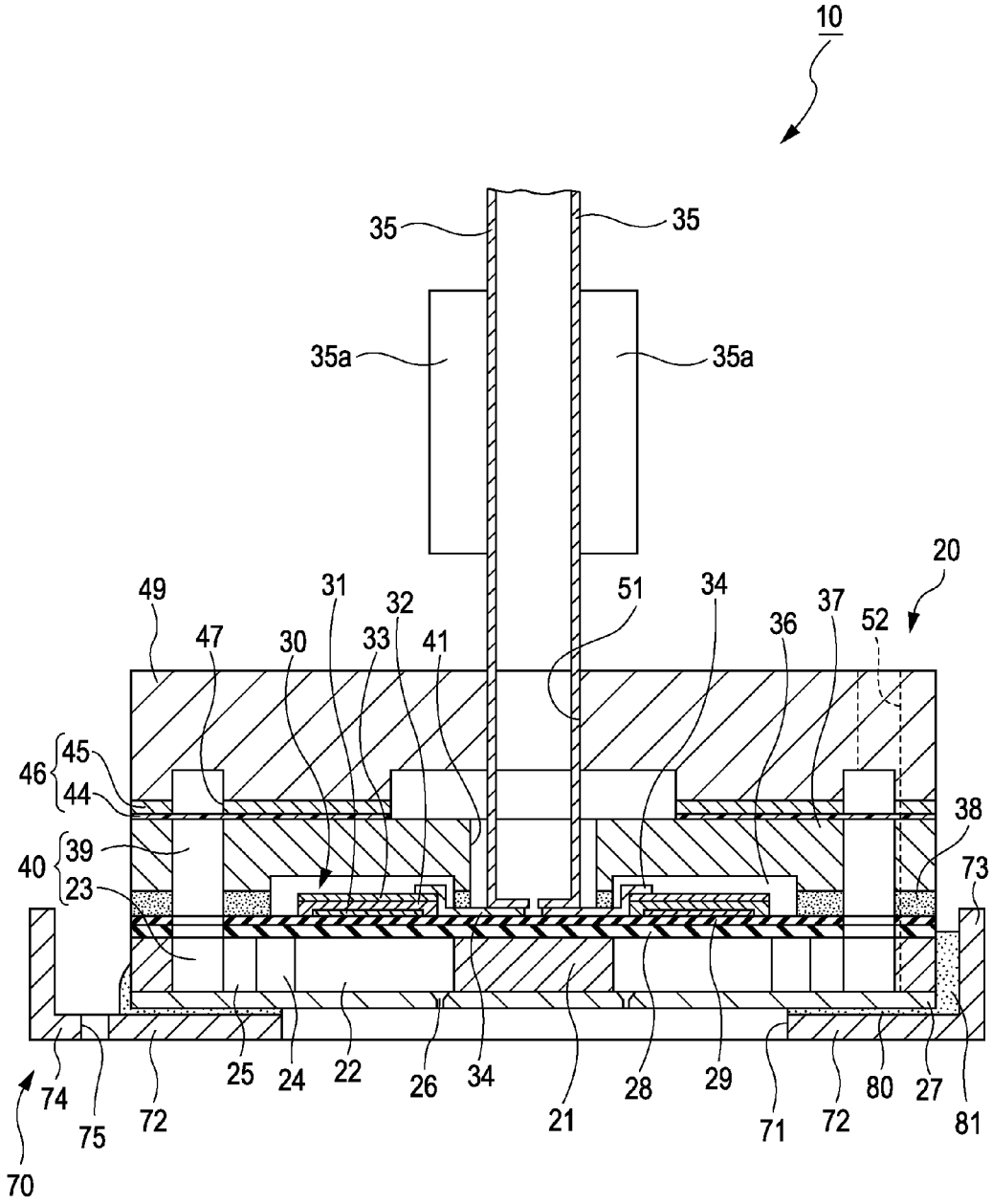
FIG. 5 is a cross-sectional view of the liquid ejecting head according to the first embodiment.

An exemplary configuration of each of the heads 10 held by the holding member 60 configured as stated above will be described with reference to FIGS. 3 to 5. FIG. 3 is an exploded perspective view of the head 10 according to the first embodiment of the invention. FIG. 4 is a plan view of the head 10, viewed from a liquid-ejecting surface side. FIG. 5 is a cross-sectional view of the head 10 in a long-side direction of pressure generation chambers.

As shown in FIGS. 3 to 5, two rows of a plurality of pressure generation chambers 22 are aligned in a channel formation substrate 21 in a width direction of the channel formation substrate 21. A communicating unit 23 is formed in a region outside of each row of the pressure generation chambers 22 in a long-side direction of the pressure generation chambers. The communicating unit 23 communicates with a corresponding pressure generation chamber 22 via an ink supply path 24 and a communication path 25 that are provided per pressure generation chamber 22.

A nozzle plate 27 is bonded onto one surface of the channel formation substrate 21. The nozzle openings 26 each communicating with a region in the vicinity of an opposite end of pressure generation chambers 22 to the ink supply path 24 are pierced in the nozzle plate 27.

On the opposite surface of the channel formation substrate 21 to the nozzle plate 27, piezoelectric actuators 30 are formed via an elastic film 28 and an insulating film 29. Each of the piezoelectric actuators 30 is configured to include a first electrode 31, a piezoelectric layer 32, and a second electrode 33. A lead electrode 34 extending onto the insulating film 29 is connected to the second electrode 33 constituting each piezoelectric actuator 30. One end of the lead electrode 34 is connected to the second electrode 33 of one piezoelectric actuator 30 and the other end thereof is connected to one driving interconnection 35 that serves as a flexible interconnection member (COF substrate) and on which a driving IC 35*a* for driving the piezoelectric actuator 30 is mounted.

A protection substrate 37 is bonded by an adhesive 38 onto the channel formation substrate 21 on which the piezoelectric actuators 30 configured as stated above are formed. The protection substrate 37 includes piezoelectric-actuator holding units 36, which serve as a space for protecting the piezoelectric actuators 30, at regions facing the respective piezoelectric actuators 30. Manifold units 39 are provided on the protection substrate 37. In the first embodiment, each of the manifold units 39 communicates with a corresponding one of the communicating units 23 of the channel formation substrate 21 and one manifold unit 39 and one communicating unit 23 constitute a manifold 40 that serves as a common ink chamber to the respective pressure generation chambers 22 in each row.

A through-hole 41 penetrating the protection substrate 37 in a thickness direction of the protection substrate 37 is provided in the protection substrate 37. In the first embodiment, the through-hole 41 is provided between the two piezoelectric-actuator holding units 36. A region in the vicinity of the end of the lead electrode 34 led out from each piezoelectric actuator 30 and connected to the driving interconnection 35 is exposed to the through-hole 41.

Furthermore, a compliance substrate 46 configured to include a sealing film 44 and a fixed plate 45 is bonded onto the protection substrate 37. The sealing film 44 is made of a low-rigidity, flexible material and seals one surface of each manifold unit 39. The fixed plate 45 is made of a hard material such as metal. A region of the fixed plate 45 facing the manifold 40 is formed into an opening 47 from which the fixed plate 45 is completely removed in a thickness direction of the fixed plate 45. Due to this, only the flexible sealing film 44 seals one surface of each manifold 40. Compliance is applied into each manifold 40 in the region sealed only by the sealing film 44. Furthermore, ink introduction ports 48 for introducing inks into the respective manifolds 40 are provided in the compliance substrate 46.

A head case 49 serving as a case member is fixed onto the compliance substrate 46. Ink introduction paths 50 communicating with the respective ink introduction ports 48 and supplying the inks to the manifolds 40 from storage units (not shown) such as cartridges are provided in the head case 49. An interconnection-member holding hole 51 communicating with the through-hole 41 provided in the protection substrate 37 is provided in the head case 49. One end of each driving interconnection 35 is connected to one lead electrode 34 in a state in which the driving interconnection 35 is inserted into the interconnection-member holding hole 51.

In the head main body 20 according to the first embodiment stated above, the inks from the storage units are introduced from the ink introduction ports 48 via the holding member 60, and interiors of the manifolds 40 up to the nozzle openings 26 are filled with the inks. Thereafter, a voltage is applied to the piezoelectric actuators 30 corresponding to the pressure generation chambers 22, according to a recording signal from the driving ICs 35*a*, whereby the elastic film 28, the insulating film 29, and the piezoelectric actuators 30 are subjected to flexural deformations. This increases the internal pressures of the pressure generation chambers 22, thereby discharging ink droplets from the nozzle openings 26.

Moreover, a positioning hole 52 is provided in two corners of each constituent member in a long-side direction thereof. Pins for positioning the constituent members of the head main body 20 during assembly are inserted into the positioning holes 52, respectively. The head main body 20 is formed integrally by inserting the pins into the positioning holes 52 and bonding together the constituent members of the head main body 20 while positioning the respective members relatively to one another.

A cover head 70 serving as a fixed plate is fixed to the liquid ejecting surface 27*a* of such a head main body 20 in which the nozzle openings 26 of the nozzle plate 27 are formed.

The cover head 70 is of a box shape formed by bending edges of a rectangular plate member toward side surfaces of the head main body 20 and standing upright the bent edges. A bottom of the cover head 70 is bonded to the surface of the nozzle plate 27 that is the liquid ejecting surface 27*a* with an adhesive 80.

Specifically, the cover head 70 includes a rectangular exposure opening 71 to which the nozzle openings 26 are exposed, and a rectangular frame 72 that defines the exposure opening 71 and that is provided along peripheral edges of the nozzle plate 27 that is the liquid ejecting surface 27*a*. Sidewalls 73 extending so as to be bent over outer edges of the liquid ejecting surface 27*a* are provided on side surfaces of the liquid ejecting surface 27*a* of the head main body 20, respectively.

An outer periphery of the frame 72 is larger than that of the nozzle plate 27 that is the liquid ejecting surface 27*a*, and an inner periphery thereof, that is, the exposure opening 72 defined by the frame 72 is smaller than the outer periphery of the nozzle plate 27. Due to this, the frame 72 is bonded to the peripheral edges of the nozzle plate 27 with the adhesive 80 while facing the outer edges of the nozzle plate 27. The frame 72 is provided to be large enough to close the positioning holes 52 of the nozzle main body 20 at a position so as to close the positioning holes 52. That is, since the two positioning holes 52 are formed in the paired corners on both ends of the surface (liquid ejecting surface 27*a*) of the nozzle plate 27 in the long-side direction thereof, respectively, the frame 72 is provided to be wide enough to close these positioning holes 52.

The frame 72 configured as stated above includes an extension portion 74 protruding from the liquid ejecting surface 27*a*. In the first embodiment, a side of the frame 72 on one side surface (long side) of the liquid ejecting surface 27*a* extends in the short-side direction of the liquid ejecting surface 27*a* to an opposite side to the head main body 20, thereby forming the extension portion 74. Actually, however, the frame 72 protrudes from all of a total of four sides of the liquid ejecting surface 27*a*, that is, two long sides and two short sides. However, it is preferable that protrusion amounts of the frame 72 on the three sides except for one side corresponding to the extension portion 74 are as small as possible for the following reason. If the protrusion amounts of the frame 72 by which the frame 72 protrudes from the liquid ejecting surface 27*a* are large, then rigidity of the frame 72 becomes low in protruding regions, possibly causing defects such as deformation of the frame 72 due to paper jamming or the like and separation of the cover head 70 due to the deformation of the frame 72. Moreover, a surface area of each head 10 increases, which disadvantageously increases the distance from the nozzle openings 26 of one head 10 to the nozzle openings 26 of the adjacent heads 10. Due to this, in the first embodiment, the protrusion amounts of the frame 72 on all the sides but the side corresponding to the extension portion 74 by which the frame 72 protrudes from the liquid ejecting surface 27*a* are set small whereas the protrusion amount of the extension portion 74 is set larger than those of the other sides. Note that the protrusion amount of the extension portion 74 needs to be large enough to ensure providing the head positioning holes 75 in the extension portion 74 such that an adhesive 81 applied on the side surface of the head main body 20, to be described later, is prevented from entering the head positioning holes 75.

The two head positioning holes 75 are provided in the extension portion 74 in a long-side direction of the extension portion 74. That is, the head positioning holes 75 are provided in regions that do not face the liquid ejecting surface 27*a* of the head main body 20. In other words, in the first embodiment, the extension portion 74 obtained by widening one side of the frame 72 in the short-side direction of the liquid ejecting surface 27*a* is provided to locate the head positioning holes 75 at the positions at which the head positioning holes 75 do not face the liquid ejecting surface 27*a*. These head positioning holes 75 are used for positioning of the head 10 with respect to the holding member 60 when the head 10 is to be held by the holding member 60, as described later in detail. Due to this, higher positioning accuracy is ensured if the two head positioning holes 75 are as distant as possible. Accordingly, the extension portion 74 is provided on one long side of the liquid ejecting surface 27*a*, and the two head positioning holes 75 are provided at the positions distant from each other in the long-side direction (first direction Y) of the liquid ejecting surface 27*a*, respectively. For reference, if the extension portion 74 is provided on one end in the long-side direction (on one short side), the two head positioning holes 75 may be shifted apart only in the short-side direction and the distance between the two head positioning holes 75 is small, resulting in lower positioning accuracy.

In the first embodiment, the two head positioning holes 75 are formed of two single holes. However, the two head positioning holes 75 are not limited to the single holes. For example, a single hole and an elongated hole (having a major axis in the long-side direction of the liquid ejecting surface 27*a*) may be provided. This may facilitate positioning the head 10 even if an error occurs when positioning the head 10 using the two types of pins (first positioning pins 102 and head positioning pins 64 to be described later).

The frame 72 of the cover head 70 thus configured is bonded to the liquid ejecting surface 27*a* via the adhesive 80 as stated above. Furthermore, in the first embodiment, the adhesive 81 is applied over the corners defined by the cover head 70 and the side surface of the head main body 20. This adhesive 81 is intended to prevent ink adhering onto the liquid ejecting surface 27*a* from passing through an interface or the like of the adhesive 80 and entering into the side surface of the head main body 20, and to prevent damage to the head main body 20 by the ink. It is necessary to arrange the head positioning holes 75 at positions outside of regions in which the adhesive 81 is applied. If the adhesive 81 spreads toward the liquid ejecting surface 27*a* from the head positioning holes 75, the spreading adhesive 81 becomes a foreign matter, and the following disadvantages may occur. The foreign matter, that is, the adhesive 81 falls onto a recording target medium at an unexpected time such as when wiping using a rubber blade (not shown) or when printing, and spoils the recording target medium. Furthermore, if the head positioning holes 75 are filled with the adhesive 81, it is difficult to position the head 10 with respect to the holding member 60.

In the head 10 including the head main body 20 and the cover head 70 as stated above, the cover head 70 closes the liquid ejecting surface 27*a*-side openings of the positioning holes 52 used when positioning the respective constituent members of the head main body 20. This may prevent ink adhering onto the liquid ejecting surface 27*a* from entering the head main body 20 via the positioning holes 52 and prevent damage to the head main body 20 by the entering ink. Further, in the head 10, the head positioning holes 75 are provided in the cover head 70. Due to this, even if the cover head 70 closes the positioning holes 52 of the head main body 20, the head 10 may be positioned with respect to the holding member 60 without the need to use any expensive aligner during positioning. It is, therefore, possible to reduce the manufacturing cost of the head unit 1.

Figure 6A:
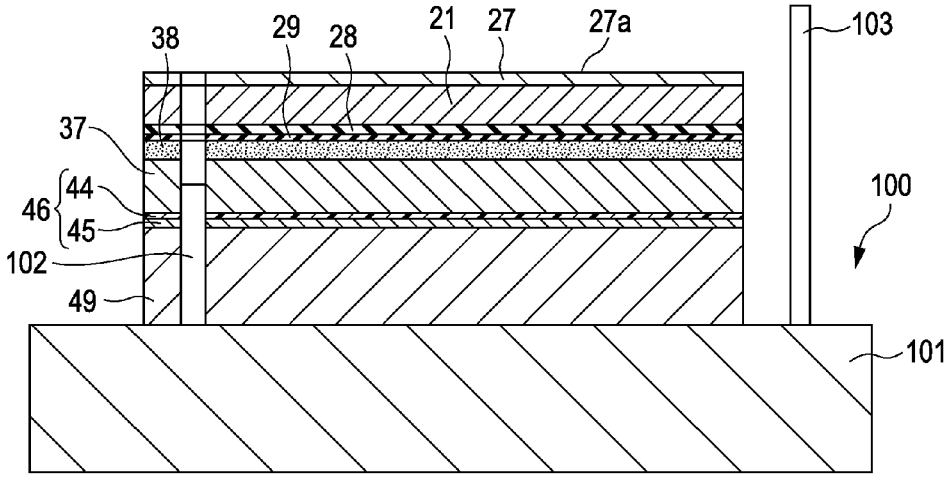
FIGS. 6A and 6B are cross-sectional views showing a method of manufacturing the liquid ejecting head according to the first embodiment.
Figure 6B:
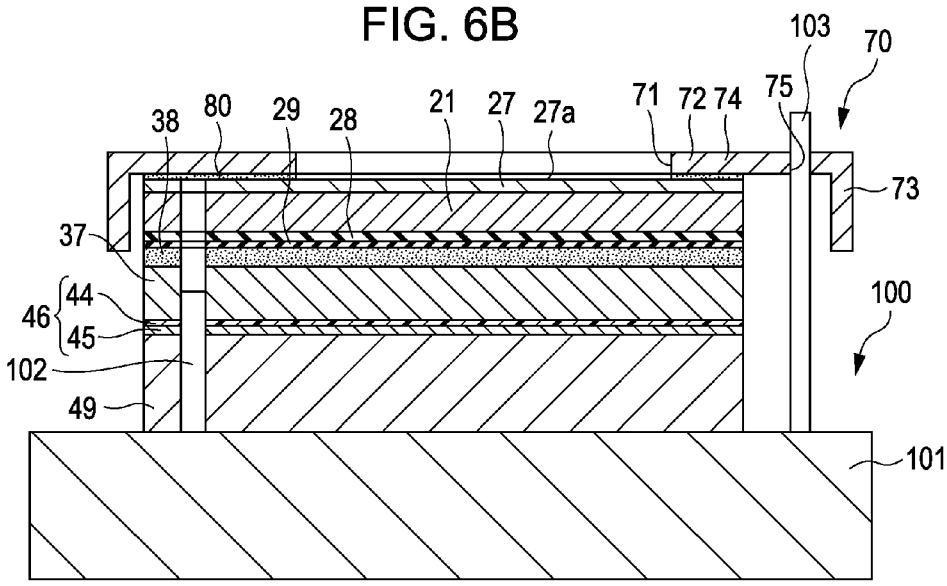

A method of manufacturing the head 10 stated above, particularly a method of assembling together the head main body 20 and the cover head 70 is described. FIGS. 6A and 6B are cross-sectional views showing the method of manufacturing the ink jet recording head 10.

To assembly the head 10, a positioning tool 100 shown in FIG. 6A is used. The positioning tool 100 includes a base member 101, the first positioning pin 102 provided on the base member 101, and a second positioning pin 103 provided on the base member 101.

The base member 101 is a plate member made of, for example, metal such as stainless steel and at least one surface of the base member 101 is formed to be highly accurately flat.

The first positioning pin 102 is a rod member having a proximal end that is fixed and held perpendicularly to the flat surface of the base member 101. This first positioning pin 102 has such an outside diameter that the first positioning pin 102 is inserted into one positioning hole 52 of the head main body 20. Two first positioning pins 102 are provided to correspond to the positioning holes 52, respectively.

Each of the first positioning pins 102 protrudes from the flat surface of the base member 101 by a smaller protrusion amount than a length of each positioning pin 52 of the head main body 20. By so setting, while each first positioning pin 102 is inserted into the corresponding positioning hole 52 of the head main body 20 and the head main body 20 is mounted on the flat surface of the base member 101, the first positioning pin 102 does not protrude from the upper surface (liquid ejecting surface 27*a*) of the head main body 20. Note that the two first positioning pins 102 are arranged at the same distance as that between the two positioning holes 52. Furthermore, the first positioning pins 102 are inserted from the head case 49 side of the head main body 20. Due to this, the first positioning pins 102 are provided to be short enough not to protrude from the liquid ejecting surface 27*a* that corresponds to the surface of the nozzle plate 27.

The second positioning pin 103 is a rod member having a proximal end that is fixed and held perpendicularly to the flat surface of the base member 101. This second positioning pin 103 has such an outside diameter that the second positioning pin 103 is inserted into one head positioning hole 75 of the cover head 70. Two second positioning pins 103 are provided to correspond to the head positioning holes 75, respectively.

Each of the second positioning pins 102 protrudes from the flat surface of the base member 101 by a larger protrusion amount than a thickness of the head main body 20 (the length of the positioning hole 52). By so setting, tip ends of the second positioning pins 103 is inserted into the respective head positioning holes 75 of the cover head 70 mounted on the liquid ejecting surface 27*a* of the head main body 20.

The first positioning pins 102 and the second positioning pins 103 are positioned at predetermined positions, respectively. The positioning holes 52 of the head main body 20 are positioned at predetermined positions with respect to positions of the nozzle openings 26. Due to this, the first positioning pins 102 inserted into the respective positioning holes 52 and the second positioning pins 103 inserted into the respective head positioning holes 75 are arranged so that the nozzle openings 26 and the head positioning holes 75 of the cover head 70 are located at the predetermined positions. By using the above-stated positioning tool 100, the two head positioning holes 75 of the cover head 70 are positioned at the predetermined positions with respect to the positions of the nozzle openings 26.

To assemble together the head main body 20 and the cover head 70 using this positioning tool 100, the head main body 20 is mounted on the base member 101 first by inserting the first positioning pins 102 of the positioning tool 100 into the respective positioning holes 52 from the head case 49-side of the head main body 20, as shown in FIG. 6A. The head main body 20 used at this time is obtained by assembling together the respective constituent members (such as the nozzle plate 27, the channel formation substrate 21, the protection substrate 37, the compliance substrate 46, and the head case 49) of the head main body 20 while positioning the constituent members using the first positioning pins 102 inserted into the respective positioning holes 52 of each of the constituent members.

Next, as shown in FIG. 6B, the second positioning pins 103 are inserted into the respective head positioning holes 75 of the cover head 70 and the cover head 70 is mounted on the liquid ejecting surface 27*a* of the head main body 20. It is thereby possible to position the cover head 70 and the head main body 20 relatively to each other. At this time, the relative positioning of the cover head 70 and the head main body 20 and bonding of the cover head 70 onto the head main body 20 may be simultaneously performed by applying in advance the adhesive 80 onto the surface of the liquid ejecting surface 27*a* which is made to abut the cover head 70.

In this way, the head main body 20 and the cover head 70 are positioned and fixed to each other, thereby covering the liquid ejecting surface 27*a*-side openings of the positioning holes 52 of the head main body 20 with the cover head 70. That is, an expensive aligner including an imaging unit is conventionally used to position the head main body 20 and the cover head 70 while the cover head 70 closes the positioning holes 52 of the head main body 20. In the first embodiment, by contrast, the cover head 70 and the head main body 20 may be easily positioned and bonded to each other while the cover head 70 closes the positioning holes 52 of the head main body 20 by not using any expensive aligner but using the relatively inexpensive positioning tool 100.

Thereafter, the adhesive 81 is applied to spread over the corners defined by the side surface of the head main body 20 and the cover head 70, thereby forming the head 10 shown in FIG. 5. At this time, the adhesive 81 does not close the head positioning holes 75 because the head positioning holes 75 are provided in the extension portion 74 of the cover head 70. Furthermore, the adhesive 81 is not discharged from a rear surface (head case 49-side) of the cover head 70 onto the surface of the nozzle plate 27 via the head positioning holes 75. This may prevent unnecessary amounts of the adhesive 81 from becoming the foreign matter, and prevent the foreign matter from falling onto the recording target medium at an unexpected time such as when wiping by the rubber plate or when printing and from spoiling the recording target medium. Moreover, the head 10 is positioned with respect to the holding member 60 using the head positioning holes 75.

Each of the heads 10 formed as stated above is positioned with respect to and fixed to the holding member 60 using the head positioning holes 75, thereby forming the head unit 1. In the first embodiment, as shown in FIG. 2, the head positioning pins 64 to be inserted into the respective head positioning holes 75 of each head 10 are provided on the bottom of the holding member 60, and the head positioning pins 64 are inserted into the respective head positioning holes 75 of the head 10. By doing so, the heads 10 are positioned with respect to the holding member 60 and positioned relatively to one another. That is, the head positioning pins 64 are arranged on the bottom of the holding member 60 in advance so as to be able to relatively position the nozzle openings 26 of the respective heads 10 via the head positioning holes 75 of the head 10.

Moreover, as shown in FIG. 2, the two rows of a plurality of (two in FIG. 2) heads 10 aligned in the first direction Y are aligned in the second direction X crossing the direction (first direction Y) in which the nozzle openings 26 are aligned. The two heads 10 adjacent in the second direction X (short-side direction) are arranged so that the opposite surfaces (long sides) of the heads 10 to the surfaces (long sides) on which the head positioning holes 75 are provided face each other. This may decrease the distance between the nozzle openings 26 in the head 10 in one of the two rows and those in the other row. This may, in turn, prevent the head unit 1 from becoming large in the second direction X and may decrease the size of the head unit 1. Moreover, by decreasing the distance from the nozzle openings 26 of one head 10 to the nozzle openings 26 of the adjacent heads 10 in the short-side direction (second direction X), it is possible to reduce deviations in timing at which ink droplets discharged from the two heads 10 fall and adhere onto the recording target medium, prevent generation of color difference and stripes due to a difference of the ink droplets in the spread amount on the recording target medium, and improve printing quality.

A method of positioning the heads 10 with respect to the holding member 60 is not limited to the method using the head positioning pins 64 provided on the holding member 60. Alternatively, a similar tool to the above-stated positioning tool 100 may be used.

Figure 7A:
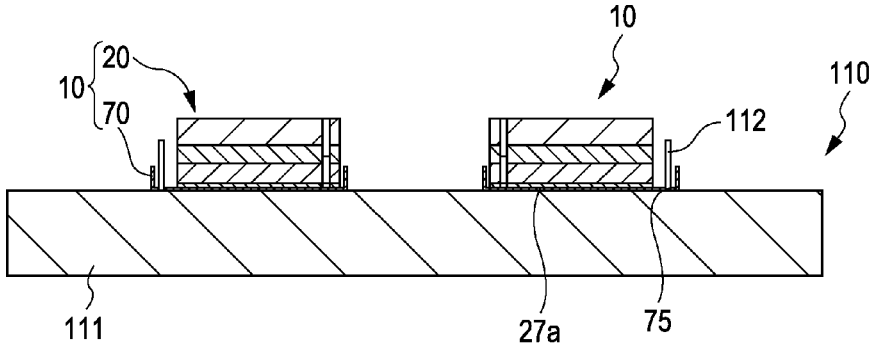
FIGS. 7A and 7B are cross-sectional views showing a method of manufacturing the liquid ejecting head unit according to the first embodiment.
Figure 7B:
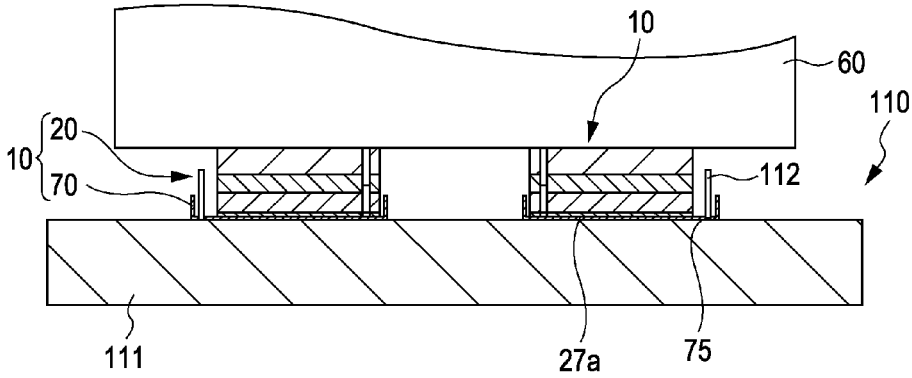

A method of assembling the head unit 1 using a head positioning tool is described. FIGS. 7A and 7B are cross-sectional views showing the method of manufacturing the head unit 1.

As shown in FIG. 7A, a head positioning tool 110 includes a base member 111 and a plurality of third positioning pins 112 provided on the base member 111.

The third positioning pins 112 are inserted into the respective head positioning holes 75 of each of the heads 10 to position the heads 10 relatively to one another. Each of the third positioning pins 112 has a smaller length than a thickness of the head 10. It is thereby possible to protrude a surface of the head case 49, the surface being bonded to the holding member 60, toward the holding member 60 by a larger protrusion amount than that of each of the third positioning pins 112 and to abut the head case 49 on the holding member 60 before the third positioning pins 112 are abutted on the holding member 60 when the third positioning pins 112 are inserted into the respective head positioning holes 75 of the head 10.

To assemble the head unit 1 using such a head positioning tool 110, the heads 10 are held on the head positioning tool 110 first by inserting the third positioning pins 112 of the head positioning tool 110 into the head positioning holes 75 of each of the heads, respectively, as shown in FIG. 7A. The third positioning pins 112 are inserted into the respective head positioning holes 75 from the liquid ejecting surface 27*a*-side of each head 10. The heads 10 are thereby positioned relatively to one another.

Next, as shown in FIG. 7B, the holding member 60 is abutted on and bonded onto head cases 49 of the heads 10. At this time, positioning of the base member 111 and the holding member 60 may be performed using other positioning pins or the like that are not shown. As a result, the head unit 1 is formed. In this way, the liquid ejecting surfaces 27*a* of the heads 10 are mounted on the base member 111 and the heads 10 are relatively positioned using the head positioning tool 110, thereby making it possible to make heights of the liquid ejecting surfaces 27*a* of the heads 10 held on the holding member 60 uniform and improve the printing quality.

The positioning of the heads 10 and the holding member 60 and the positioning of the heads 10 relative to one another may be performed by a method using a glass mask on which alignment marks are put, an image processing using the aligner that includes the imaging unit, or the like. However, if the head unit 1 is assembled by the method using the head positioning pins 64 or the method using the head positioning tool 110, it is possible to dispense with an expensive aligner and reduce the manufacturing cost of the head unit 1.

Second Embodiment

Figure 8:
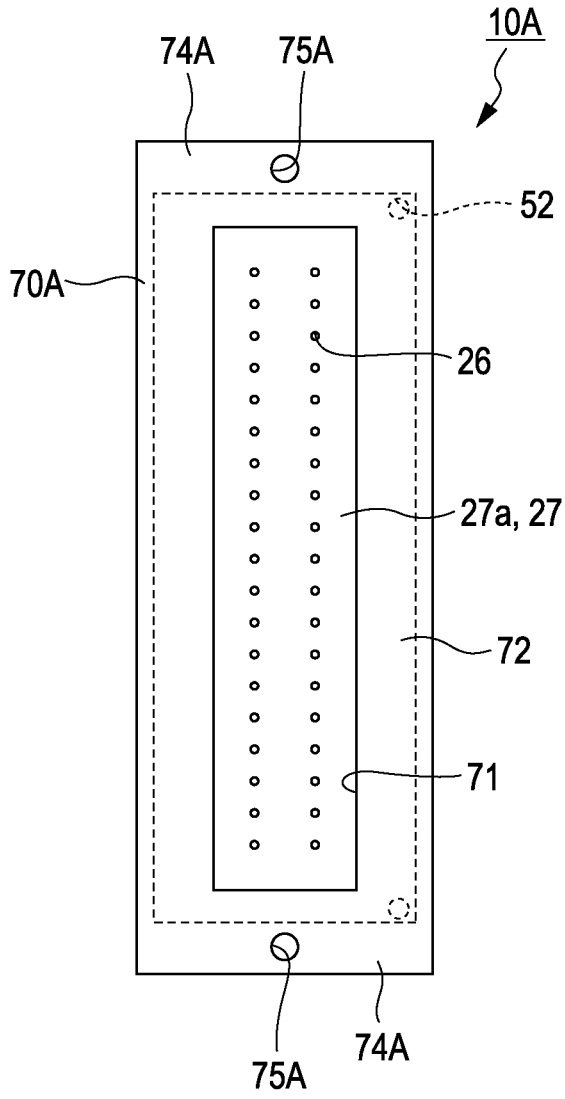
FIG. 8 is a plan view of a liquid ejecting head according to a second embodiment of the invention.
Figure 9:
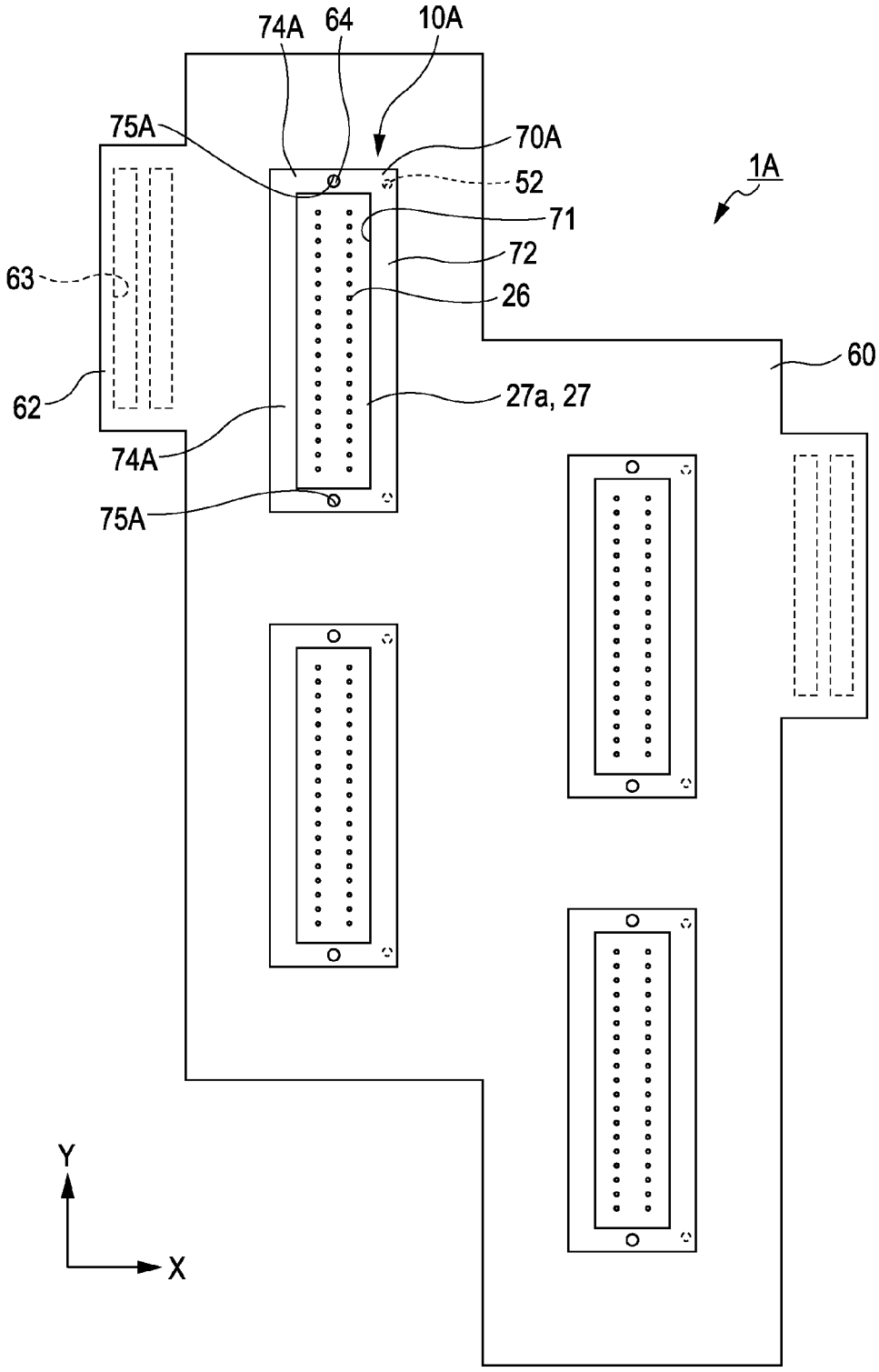
FIG. 9 is a plan view of a liquid ejecting head unit according to the second embodiment.

FIG. 8 is a plan view of an ink jet recording head that is an example of a liquid ejecting head according to a second embodiment of the invention. FIG. 9 is a plan view of the ink jet recording head. Members that are the same as those according to the first embodiment described above are denoted by like reference symbols and not repeatedly described herein.

As shown in FIG. 8, a cover head 70A according to the second embodiment includes extension portions 74A on both sides of the liquid ejecting surface 27*a* in a long-side direction of the cover head 70A, respectively, and one head positioning hole 75A is provided per extension portion 74A.

As shown in FIG. 9, a plurality of heads 10A each including the head cover 70A is held by the holding member 60, thereby constituting a head unit 1A.

In this case, even if the heads 10A are held by the holding member 60 in the same direction without inverting two heads 10A adjacent in the short-side direction (second direction X) with respect to each other differently from the first embodiment, the distance between the nozzle openings 26 of the head 10A in one row and those in the other row is not increased.

Third Embodiment

Figure 10:
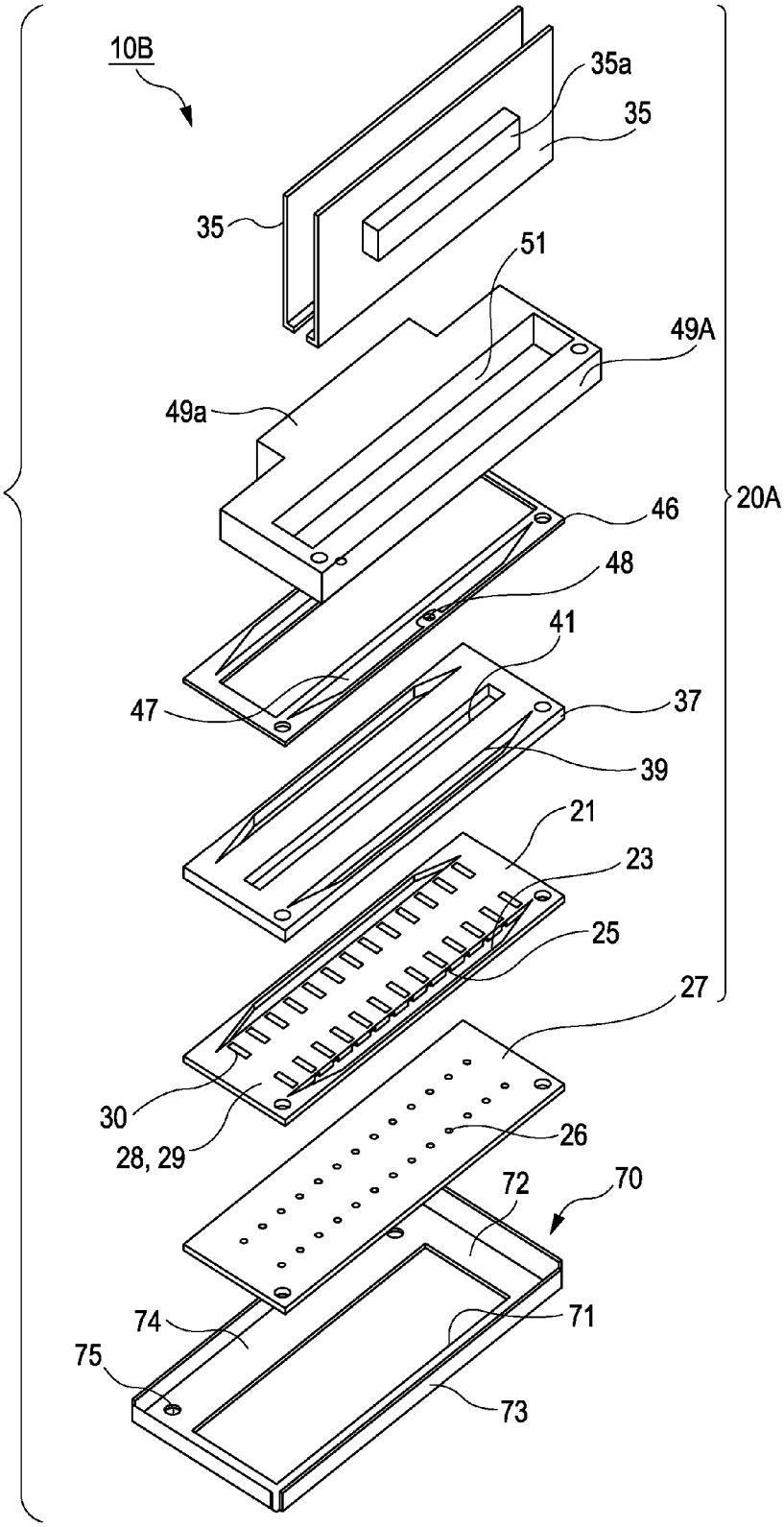
FIG. 10 is an exploded perspective view of a liquid ejecting head according to a third embodiment of the invention.
Figure 11:
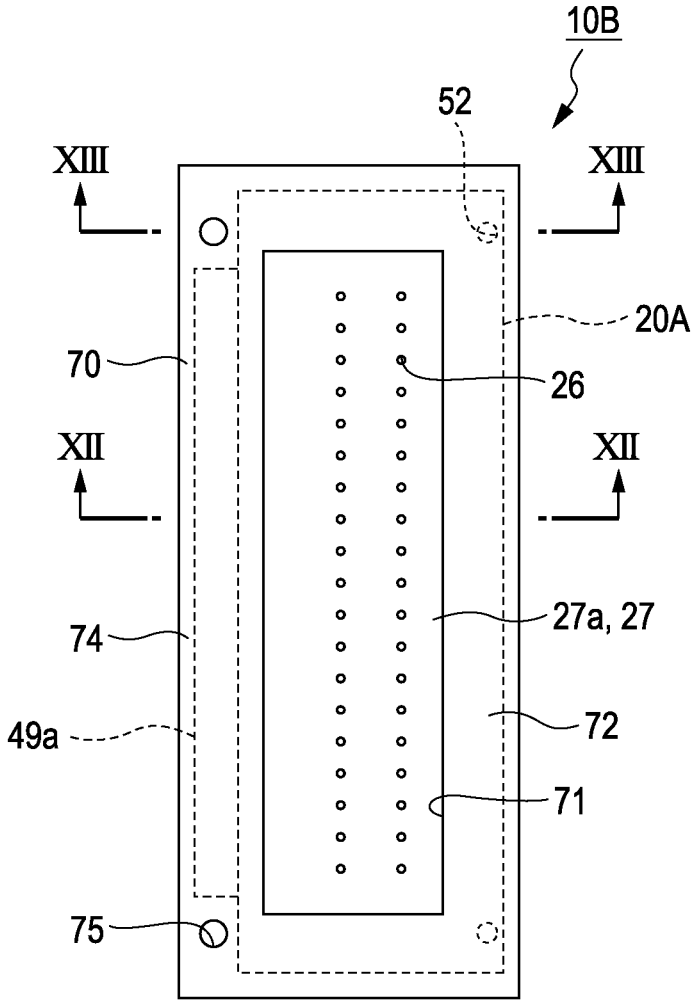
FIG. 11 is a plan view of the liquid ejecting head according to the third embodiment.
Figure 12:
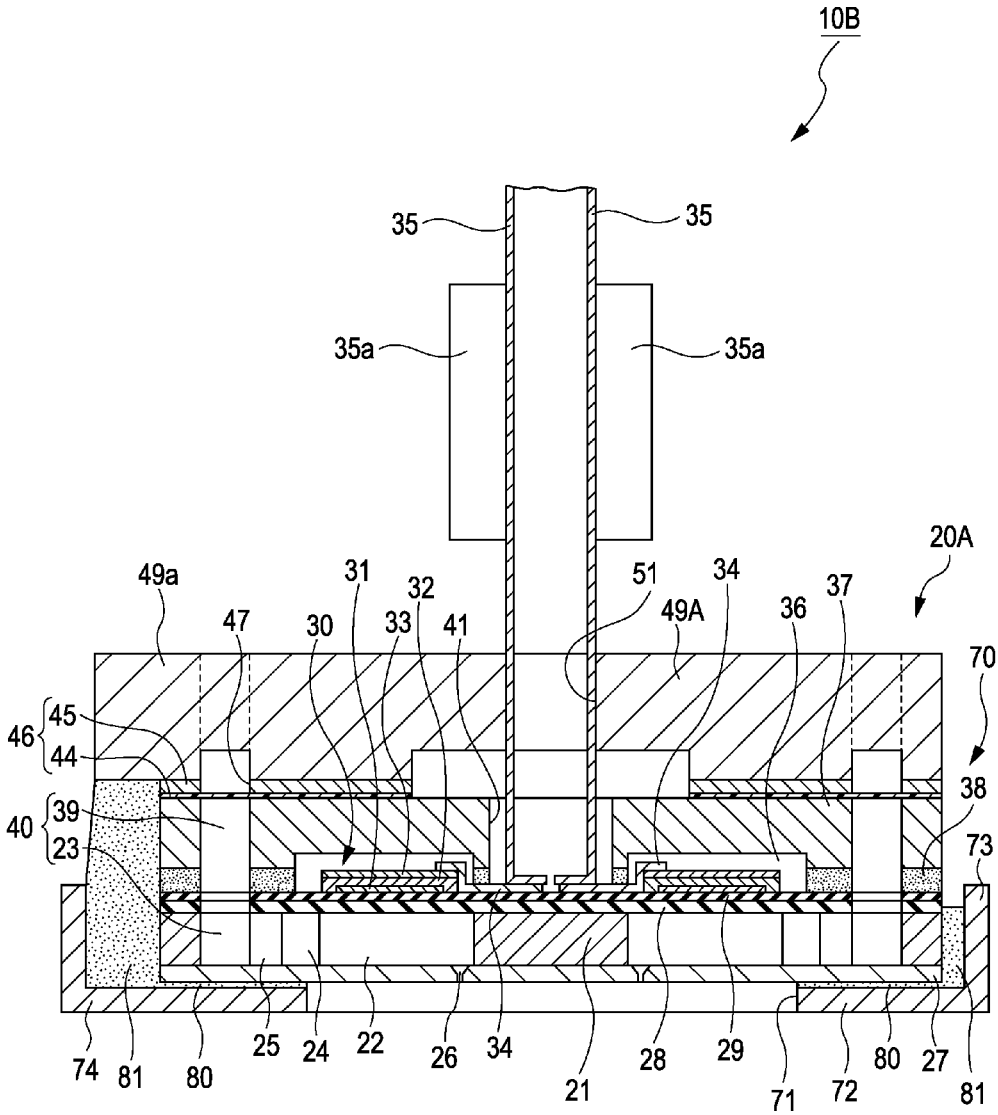
FIG. 12 is a cross-sectional view of the liquid ejecting head according to the third embodiment.
Figure 13:
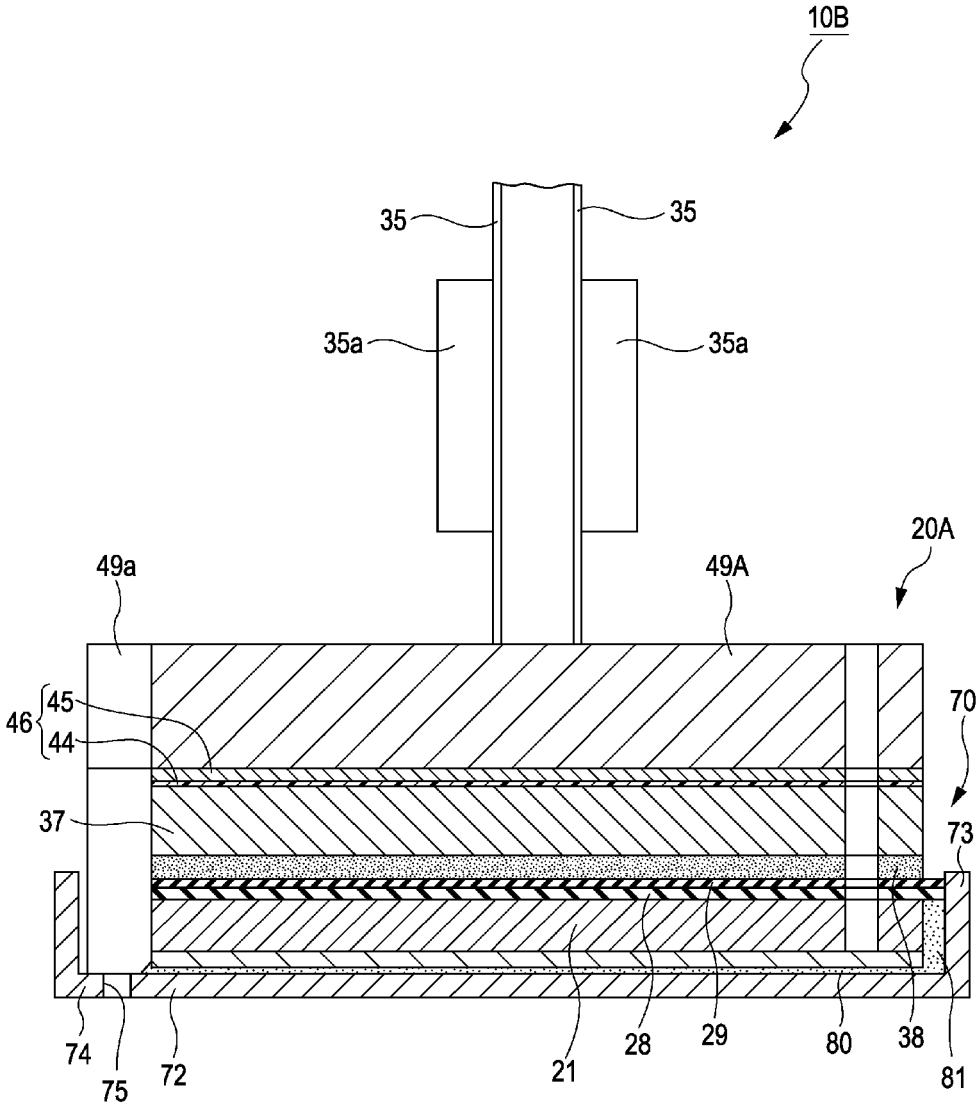
FIG. 13 is a cross-sectional view of the liquid ejecting head according to the third embodiment.

FIG. 10 is an exploded perspective view of an ink jet recording head that is an example of a liquid ejecting head according to a third embodiment of the invention. FIG. 11 is a plan view of the ink jet recording head. FIG. 12 is a cross-sectional view taken along a line XII-XII of FIG. 11, and FIG. 13 is a cross-sectional view taken along a line XIII-XIII of FIG. 11. Members that are the same as those according to the preceding embodiments are denoted by like reference symbols and are not repeatedly described herein.

As shown in FIGS. 10 to 13, a head 10B includes a head main body 20A and the cover head 70.

The head main body 20A is similar to the head 10 according to the first embodiment except that the head main body 20A includes a head case 49A that includes a protrusion 49*a*.

The head case 49A includes the protrusion 49*a* extending and protruding toward a position at which the protrusion 49*a* faces the extension portion 74 of the cover head 70. The protrusion 49*a* is provided to protrude over regions of the cover head 70 other than the region including the head positioning holes 75 by avoiding the head positioning holes 75.

This protrusion 49*a* is provided on the head case 49A, and the protrusion 49*a* functions as a reinforcement reinforcing the extension portion 74 of the cover head 70 as a result of applying the adhesive 81 between the extension portion 74 and the protrusion 49*a*. This may prevent deformation or the like of the extension portion 74.

Other Embodiments

The embodiments of the invention have been described so far. However, a basic configuration of the invention is not limited to those described above.

For example, in each of the heads 10, 10A, and 10B according to the respective embodiments, one head main body 20 or 20A is provided per cover head 70 or 70A. However, the number of head main bodies 20 or 20A is not limited to one but two or more head main bodies 20 or 20A may be provided per cover head 70 or 70A.

Furthermore, in the preceding embodiments, the thin-film piezoelectric actuators 30 have been described as pressure generation units causing pressure changes in the respective pressure generation chambers 22. However, the type of the piezoelectric actuator is not limited to the thin-film piezoelectric actuator. Alternatively, other piezoelectric actuators such as thick-film piezoelectric actuators formed by a method of bonding a green sheet or the like, or longitudinal-vibration piezoelectric actuators each configured so that piezoelectric materials and electrode formation materials are alternately stacked and a resultant stack is made to expand or contract in an axial direction may be used. Furthermore, a unit having a heating element arranged in each pressure generation chamber and discharging liquid droplets from nozzle openings by means of bubbles generated as a result of heat generated by the heating element, a so-called electrostatic actuator generating static electricity between a diaphragm and an electrode, deforming the diaphragm by the static electricity, and discharging liquid droplets from the nozzle openings or the like may be used as the pressure generation unit.

Figure 14:
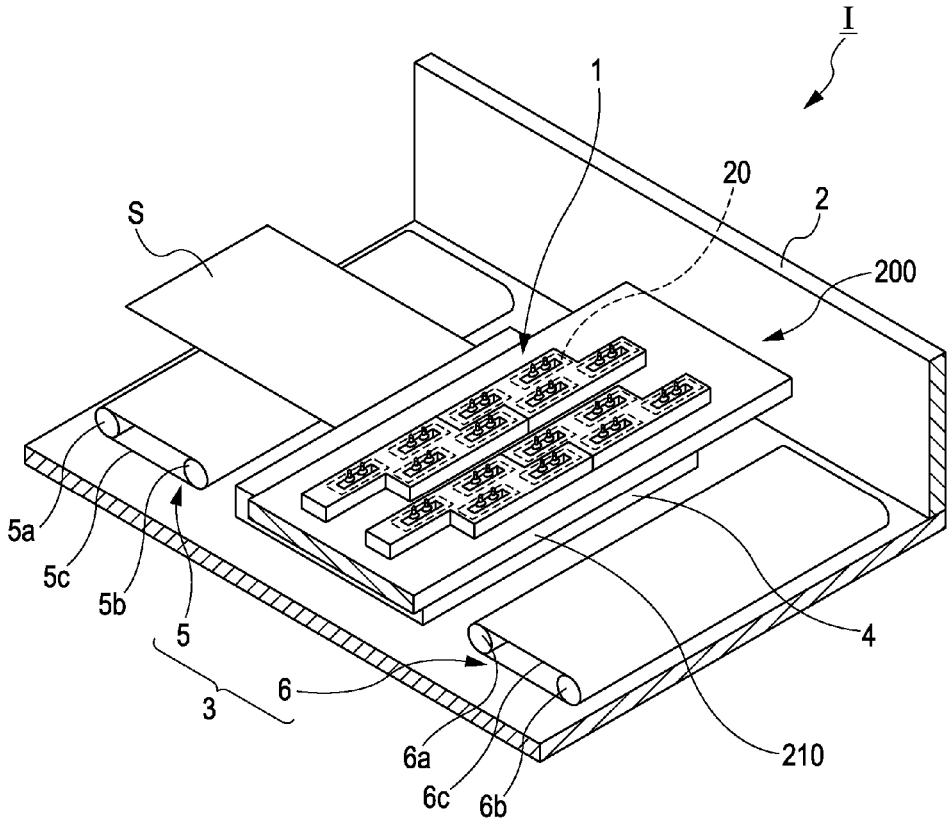
FIG. 14 is a schematic diagram of a liquid ejecting recording apparatus according to a fourth embodiment of the invention.

Moreover, as shown in FIG. 14, a plurality of (four in a fourth embodiment shown in FIG. 14, for example) head units 1 or 1A each including the heads 10, 10A or 10B according to the preceding embodiments is fixed to a fixing member, thereby constituting an ink jet recording head module 200 that is an example of a liquid ejecting head module. The head module 200 configured as stated above is mounted in an ink jet recording apparatus that is an example of a liquid ejecting apparatus. The ink jet recording apparatus according to the fourth embodiment will be described. FIG. 14 is a schematic perspective view of an ink jet recording apparatus I that is an example of the liquid ejecting apparatus according to the fourth embodiment of the invention.

As shown in FIG. 14, the ink jet recording apparatus I according to the fourth embodiment is a so-called line recording apparatus having the head module 200 fixed to the apparatus main body 2 and performing printing by transporting a recording sheet S such as paper serving as the recording target medium.

Specifically, the ink jet recording apparatus I includes the apparatus main body 2, the head module 200 fixed to the apparatus main body 2, a transport unit 3 transporting the recording sheet S serving as the recording target medium, and a platen 4 supporting a rear side of the recording sheet S opposite to a print surface thereof facing the head module 200.

The head module 200 is fixed to the apparatus main body 2 so that the first direction Y that is the direction in which the nozzle openings 26 of the heads 10 are aligned crosses a direction of transporting the recording sheet S.

The transport unit 3 includes a first transport unit 5 and a second transport unit 6 provided near both sides of the head module 200 in the transport direction of transporting the recording sheet S.

The first transport unit 5 is configured to include a driving roller 5*a*, a driven roller 5*b*, and a transport belt 5*c* wound around the driving roller 5*a* and the driven roller 5*b*. Similarly to the first transport unit 5, the second transport unit 6 is configured to include a driving roller 6*a*, a driven roller 6*b*, and a transport belt 6*c* wound around the driving roller 6*a* and the driven roller 6*b*.

Driving units such as drive motors (not shown) are connected to the driving rollers 5*a* and 6*a* of the first transport unit 5 and the second transport unit 6, respectively. Driving forces of the driving units drive the transport belts 5*c* and 6*c* to rotate, respectively, thereby transporting the recording sheet S upstream and downstream of the head module 200.

In the fourth embodiment, the first transport unit 5 configured to include the driving roller 5*a*, the driven roller 5*b*, and the transport belt 5*c* and the second transport unit 6 configured to include the driving roller 6*a*, the driven roller 6*b*, and the transport belt 6*c* have been described by way of example. The ink jet recording apparatus I may further include a holding unit holding the recording sheet S on the transport belts 5*c* and 6*c*. For example, a charger (not shown) charging an outer peripheral surface of the recording sheet S may be provided as the holding unit, and the recording sheet S charged by this charger may be attracted onto the transport belts 5*c* and 6*c* by the action of dielectric polarization. Alternatively, press rollers (not shown) may be provided on the transport belts 5*c* and 6*c* as holding units and the recording sheet S may be pinched between the press roller and the transport belt 5*c* and between the press roller and the transport belt 6*c*.

The platen 4 is made of metal, resin or the like, having a rectangular cross section, and provided between the first transport unit 5 and the second transport unit 6 to face the head module 200. The platen 4 supports the recording sheet S transported by the first transport unit 5 and the second transport unit 6 at a position facing the head module 200.

The platen 4 may include an attracting unit (not shown) attracting the transported recording sheet S onto the platen 4. Examples of the attracting unit include a unit absorbing and attracting the recording sheet S and an electrostatic chuck electrostatically attracting the recording sheet by an electrostatic force.

Although not shown, the ink storage units such as ink tanks or ink cartridges storing inks of respective colors are connected to the head module 200 so as to be able to supply the inks to the head module 200. The ink storage units may be held, for example, on the head module 200 or may be held at different positions from those on the head module 200 in the apparatus main body 2 and connected to the ink supply needles 61 of each of the head units 1 via tubes or the like. Further, external interconnections (not shown) are connected to the respective head units 1 of the head module 200.

In the ink jet recording apparatus I configured as stated above, the transport unit 5 transports the recording sheet S to the head module 200 and the head module 200 performs printing on the recording sheet S supported on the platen 4. The transport unit 3 transports the recording sheet S after printing has been completed.

FIG. 14 shows an example of the so-called line ink jet recording apparatus I configured so that the head units (head module 200) are fixed to the apparatus main body 2 and performing printing simply by transporting the recording sheet S. However, the liquid ejecting apparatus according to the invention is not limited to the line ink jet recording apparatus I. The invention is also applicable to a so-called serial recording apparatus configured such that the head units 1 (head module 200) are mounted on a carriage moving in a main scan direction crossing the transport direction of transporting the recording sheet S, and perform printing on the recording sheet S while being moved in the main scan direction.

In the embodiments stated so far, the ink jet recording head has been described as an example of the liquid ejecting head. Needless to say, the invention is targeted at wide ranges of liquid ejecting heads and applicable to other liquid ejecting heads ejecting liquids other than inks. Examples of the other liquid ejecting heads include recording heads of various types for use in an image recording apparatus such as a printer, coloring material ejecting heads for use in manufacturing of color filters for a liquid crystal display or the like, electrode-material ejecting heads for use in formation of electrodes for an organic EL display, an FED (field-emission display), and bio-organic ejecting heads for use in manufacturing of a bio-chip.

What is claimed is:

1. A liquid ejecting head comprising:

a head main body including a nozzle opening that ejects a liquid; and a fixed plate fixed to a liquid ejecting surface of the head main body, and including an exposure opening, the nozzle opening of the head main body being formed in the liquid ejecting surface of the head main body, the nozzle opening of the liquid ejecting surface being exposed to the exposure opening, wherein a positioning hole open to the liquid ejecting surface and positioned with respect to the nozzle opening is provided in the head main body, the fixed plate being fixed to the liquid ejecting surface so as to close the positioning hole, and the fixed plate includes an extension portion protruding from the liquid ejecting surface and at least two head positioning holes provided in the extension portion.

2. The liquid ejecting head according to claim 1, wherein the extension portion is provided on one side surface of the head main body in a short-side direction of the head main body, and the head positioning holes are provided in the extension portion in a long-side direction of the head main body.

3. The liquid ejecting head according to claim 2, wherein the head main body includes a case member provided on an opposite side to the liquid ejecting surface, and the case member includes a protrusion facing a region of the extension portion other than the positioning holes.

4. A liquid ejecting head unit, comprising:

a plurality of liquid ejecting heads according to claim 3; and a holding member collectively holding opposite surfaces of the liquid ejecting heads to liquid ejecting surfaces of the liquid ejecting heads.

5. A liquid ejecting apparatus comprising a liquid ejecting head according to claim 4.

6. A liquid ejecting head unit, comprising:

a plurality of liquid ejecting heads according to claim 3; and a holding member collectively holding opposite surfaces of the liquid ejecting heads to liquid ejecting surfaces of the liquid ejecting heads, wherein the liquid ejecting heads are aligned on the holding member in a short-side direction of the holding member, and the liquid ejecting heads adjacent in the short-side direction are arranged so that opposite side surfaces of the liquid ejecting heads to side surfaces on which the head positioning holes are provided face each other.

7. A liquid ejecting apparatus comprising a liquid ejecting head according to claim 6.

8. A liquid ejecting head unit, comprising:

a plurality of liquid ejecting heads according to claim 2; and a holding member collectively holding opposite surfaces of the liquid ejecting heads to liquid ejecting surfaces of the liquid ejecting heads.

9. A liquid ejecting apparatus comprising a liquid ejecting head according to claim 8.

10. A liquid ejecting head unit, comprising:

a plurality of liquid ejecting heads according to claim 2; and a holding member collectively holding opposite surfaces of the liquid ejecting heads to liquid ejecting surfaces of the liquid ejecting heads, wherein the liquid ejecting heads are aligned on the holding member in a short-side direction of the holding member, and the liquid ejecting heads adjacent in the short-side direction are arranged so that opposite side surfaces of the liquid ejecting heads to side surfaces on which the head positioning holes are provided face each other.

11. A liquid ejecting apparatus comprising a liquid ejecting head according to claim 10.

12. The liquid ejecting head according to claim 1, wherein the extension portion is provided on each of both ends of the liquid ejecting head in a long-side direction of the liquid ejecting head, and the head positioning holes are provided in the extension portions provided on the both ends of the liquid ejecting head in the long-side direction of the liquid ejecting head, respectively.

13. A liquid ejecting head unit, comprising:

a plurality of liquid ejecting heads according to claim 12; and a holding member collectively holding opposite surfaces of the liquid ejecting heads to liquid ejecting surfaces of the liquid ejecting heads.

14. A liquid ejecting apparatus comprising a liquid ejecting head according to claim 13.

15. A liquid ejecting head unit, comprising:

a plurality of liquid ejecting heads according to claim 1; and a holding member collectively holding opposite surfaces of the liquid ejecting heads to liquid ejecting surfaces of the liquid ejecting heads.

16. A liquid ejecting apparatus comprising a liquid ejecting head according to claim 15.

17. A method of manufacturing a liquid ejecting head, the liquid ejecting head including:

a head main body including a nozzle opening that ejects a liquid; and a fixed plate fixed to a liquid ejecting surface of the head main body, and including an exposure opening, the nozzle opening of the head main body being formed in the liquid ejecting surface of the head main body, the nozzle opening of the liquid ejecting surface being exposed to the exposure opening, the method comprising:

positioning the head main body and the fixed plate relatively to each other by inserting positioning pins into a positioning hole formed in the head main body and penetrating the head main body in a thickness direction of the head main body and a head positioning hole provided in an extension portion of the fixed plate protruding from the liquid ejecting surface from an opposite surface of the head main body to the liquid ejecting surface, respectively;

closing a liquid ejecting surface-side opening of the positioning hole of the head main body by the fixed plate; and fixing the head main body to the fixed plate.

* * * * *